United States Patent [19]

Lobasso et al.

[11] Patent Number: 5,052,129

[45] Date of Patent: Oct. 1, 1991

[54] HEEL REPAIR PATCHES

[76] Inventors: Jeanette A. Lobasso, 2207 W. St., Brooklyn, N.Y. 11223; George Spector, 233 Broadway, #3815, New York, N.Y. 10007

[21] Appl. No.: 500,910

[22] Filed: Mar. 29, 1990

[51] Int. Cl.[5] ..... A43B 13/22

[52] U.S. Cl. ..... 36/72 R; 36/72 B; 36/34 B; 36/73

[58] Field of Search ..... 36/72 R, 34 R, 72 B

[56] References Cited

U.S. PATENT DOCUMENTS

| | | | |
|---|---|---|---|
| 3,034,233 | 5/1962 | Massenz | 36/34 R |
| 3,035,357 | 5/1962 | Valenti | 36/34 R |
| 4,166,328 | 9/1979 | Hamilton | 36/72 R |
| 4,750,278 | 6/1988 | Cates | 36/72 R |

FOREIGN PATENT DOCUMENTS

| | | | |
|---|---|---|---|
| 2171590 | 9/1986 | United Kingdom | 36/72 R |
| 2218318 | 11/1989 | United Kingdom | 36/34 R |

*Primary Examiner*—Paul T. Sewell
*Assistant Examiner*—BethAnne Cicconi

[57] ABSTRACT

A heel repair patch is provided that includes adhesive material so that it can be applied to the heel of the shoe. In a modification a built-in heel lift and tab which fits over the seam at heel breast for better holding thereto are included.

3 Claims, 1 Drawing Sheet

HEEL REPAIR PATCHES

BACKGROUND OF THE INVENTION

The instant invention relates generally to covers for women's shoes and more specifically it relates to a heel repair patch.

Numerous covers for women's shoes have been provided in prior art that are adapted to be attached to the heel area of the shoes for protection. For example, U.S. Pat. Nos. 3,270,442; 3,302,314 and 4,756,097 all are illustrative of such prior art. While these units may be suitable for the particular purpose to which they address, they would not be as suitable for the purposes of the present invention as heretofore described.

SUMMARY OF THE INVENTION

A primary object of the present invention is to provide a heel repair patch that will overcome the shortcomings of the prior art devices.

Another object is to provide aheel repair patch that can be fabricated out of various colored materials which can then be applied to the heel of the shoe for changing the appearance of the shoe.

An additional object is to provide a heel repair patch which includes a built-in heel lift and a tab which fits over the seam of the heel breast for better holding thereto.

A further object is to provide aheel repair patch that is simple and easy to use.

A still further object is to provide a heel repair patch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
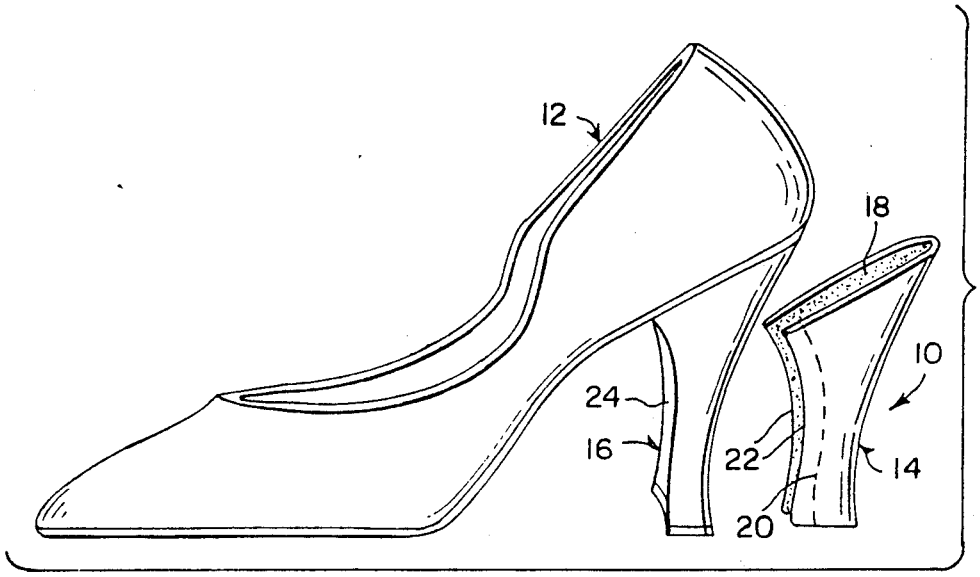
FIG. 1 is a perspective view of a woman's shoe with invention ready to be placed onto heel thereof.
Figure 2:
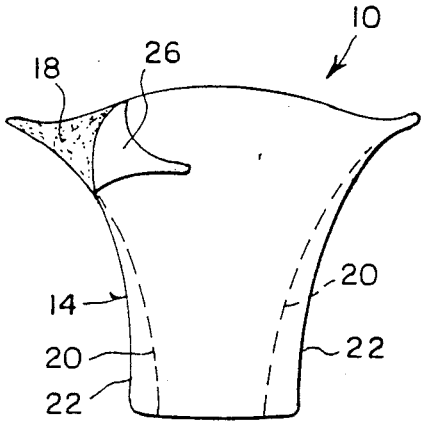
FIG. 2 is a front flat view thereof.

Turning now descriptively to the drawings, in which similar reference characters denote similar elements throughout the several views, FIGS. 1 and 2 illustrate a heel repair patch 10 for a woman's shoe 12. The patch 10 consists of a panel 14 composed of relatively resilient material characterized by a shape conforming to heel 16 of the woman's shoe 12. Pressure sensitive adhesive 18 is disposed on inner surface of the panel 14. When the panel 14 is applied to the heel 16 and folded at fold lines 20 on two sides 22, the adhesive 18 will cause the panel 14 to stick to the heel 16 with seam formed at heel breast 24 thereof.

A non-stick cover 26 being of same shape of the panel 14 is placed over the adhesive 18 and peeled away to expose the adhesive 18 when the panel 14 is to be applied to the heel 16 The panel 14 can be fabricated out of various colored materials which can then be applied to the heel 16 for changing the appearance of the shoe 12.

Figure 3:
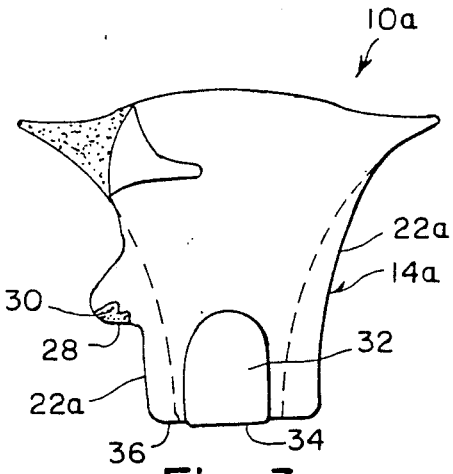
FIG. 3 is a front flat view of a modification in which a tab with adhesive fits over seam for proper holding and a built-in heel lift is hinged thereto.
Figure 4:
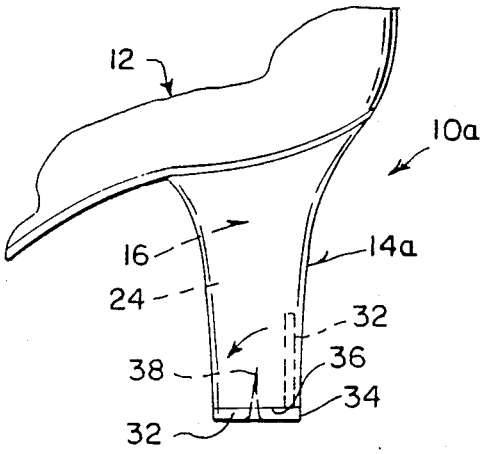
FIG. 4 is a side view with parts broken away of the modification placed onto heel of a woman's shoe.
Figure 5:
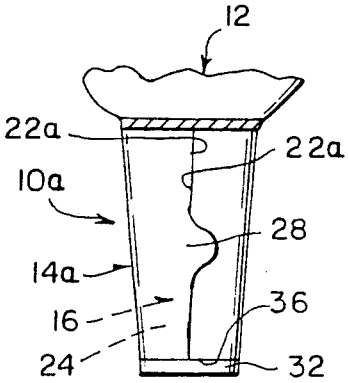
FIG. 5 is a front elevational view of the heel with patch showing the tab over the seam of the heel breast thereof.

A modified heel repair patch **10*a* is shown in FIGS. 3, 4 and 5 further including a tab 28 formed on one of the sides 22*a* of the panel 14*a*. Pressure sensitive adhesive 30 is disposed on inner surface of the tab 28, so that when the panel 14*a* is applied to the heel 16 the tab 28 will fit over the seam at the heel breast 24 for better holding thereto. A built-in heel lift 32 is pivotly hinged at rear end 34 thereof to bottom edge 36 of the panel 14*a*. When the panel 14*a* is applied to the heel 16, by a nail 38 or the like, for replacing original worn out heel lift on the shoe 12**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A heel repair patch for a woman's shoe comprising:

a) a panel composed of relatively resilient material characterized by a shape conforming to the heel of a woman's shoe; and b) pressure sensitive adhesive disposed on inner surface of said panel so that when said panel is applied to the heel and folded at fold lines on two sides, said adhesive will cause said panel to stick to the heel with a seam formed at the heel breast thereof;

c) said panel having a bottom edge;

d) a built in heel lift having spaced front and rear ends, said heel lift being pivotably mounted to said bottom edge of said panel along one of said ends of the heel lift.

2. A heel repair patch as in claim 1, further including a tab on one of said sides of the panel wherein said tab has pressure sensitive adhesive on an inner surface and extends over said seam.

3. A heel repair patch as in claim 1 which is fabricated in a plurality of colors corresponding to coordinate with various shoe colors.

* * * * *